United States Patent [19]

Kida

[11] Patent Number: 4,472,331

[45] Date of Patent: Sep. 18, 1984

[54] METHOD FOR BUILDING A REINFORCED CONCRETE STRUCTURE

[76] Inventor: Masayuki Kida, 1-13, Shin-Ogawa-cho, Shinjuku-ku, Tokyo, Japan

[21] Appl. No.: 62,514

[22] Filed: Jul. 27, 1979

[30] Foreign Application Priority Data

May 29, 1979 [JP] Japan ..... 54-65678

[51] Int. Cl.[3] ..... E04G 13/02

[52] U.S. Cl. ..... 264/31; 264/35

[58] Field of Search ..... 264/31, 35, 333

[56] References Cited

U.S. PATENT DOCUMENTS

| | | | |
|---|---|---|---|
| 3,300,943 | 1/1967 | Owens | 264/35 |
| 3,329,747 | 7/1967 | Veach | 264/31 |
| 3,692,446 | 9/1972 | Vanderklaauw | 264/34 |
| 4,069,283 | 1/1978 | Rauchfuss | 264/32 |
| 4,071,996 | 2/1978 | Muto et al. | 264/35 |

*Primary Examiner*—John Parrish

*Attorney, Agent, or Firm*—Wenderoth, Lind & Ponack

[57] ABSTRACT

A method for building a reinforced concrete structure in which column frameworks and beam frameworks each having a novel structure are assembled at a building site, and thereafter concrete is placed within column sheathing boards and beam sheathing boards around the novel column frameworks and beam frameworks, respectively. The novel column frameworks and beam frameworks are constructed by inserting column reinforcement bars and beam reinforcement bars, respectively, into the respective reinforcement bar insertion holes in column reinforcement frames and beam reinforcement frames, respectively, disposed at a predetermined intervals, each of which frames consists of a rectangular frame piece having said reinforcement bar insertion holes arrayed therein and a perpendicular upright edge extending from its outer periphery, and connecting said perpendicular upright edges to said column sheathing boards and beam sheathing boards surrounding said column reinforcement bars and beam reinforcement bars, respectively, by means of connecting members.

3 Claims, 23 Drawing Figures

METHOD FOR BUILDING A REINFORCED CONCRETE STRUCTURE

The present invention relates to improvements in a method for building a reinforced concrete structure.

Heretofore, various methods for building a reinforced concrete structure have been developed. However, every such method for building a reinforced concrete structure in the prior art has one or more of the disadvantages that members to be used in a column or a beam cannot be standardized, that the construction work is complex, that main reinforcement bars for a column or a beam cannot be arranged precisely, that it is difficult to precisely maintain a predetermined thickness of concrete covering the main reinforcement bars, that it is difficult to build the structure with a high precision, and that it is hard to shorten the construction time and to save the contruction costs.

Therefore, it is one object of the present invention to provide a novel method for building a reinforced concrete structure which has all of the following advantages: that members to be used in a column or a beam can be standardized, that the construction work is simplified, that main reinfocement bars for a column and a beam can be arranged precisely, that a predetermined thickness of concrete covering the main reinforcement bars can be maintained precisely, that the structure can be built with a high precision, and that the construction time can be shortened and thereby the construction cost can be reduced.

According to one feature of the present invention, there is provided a method for building a reinforced concrete structure including the steps of assembling column frameworks and beam frameworks at a building site, and thereafter placing concrete within column sheathing boards and beam sheathing boards attached to said column frameworks and said beam frameworks, respectively, said column frameworks and said beam frameworks being constructed by inserting column reinforcement bars and beam reinforcement bars, respectively, into the respective reinforcement bar insertion holes in column reinforcement frames and beam reinforcement frames, respectively, disposed at predetermined intervals, each of which frames consists of a rectangular frame piece having said reinforcement bar insertion holes arrayed therein and a perpendicular upright edge extending from its outer periphery, and connecting said perpendicular upright edges to said column sheathing boards and beam sheathing boards surrounding said column reinforcement bars and beam reinforcement bars, respectively, by means of connecting members.

According to the present invention, column frameworks and beam frameworks are assembled by employing column reinforcement frames and beam reinforcement frames, respectively, each of which frames consists of a rectangular frame piece having reinforcement bar insertion holes arrayed therein and a perpendicular upright edge extending from its outer periphery, has a completely closed configuration, and is shaped by pressing or the like, in place of shearing reinforcement bars such as hoop reinforcement bars, stirrup reinforcement bars, etc. The respective reinforcement frames are disposed at predetermined intervals, column reinforcement bars are inserted and beam reinforcement bars into the reinforcement bar insertion holes in said respective reinforcement frames and the perpendicular upright edges extending from the outer peripheries of the rectangular frame pieces in said respective reinforcement frames are used to connect said perpendicular upright edges to column sheathing boards and beam sheathing boards surrounding said column reinforcement bars and beam reinforcement bars, respectively, by means of connecting members. Therefore column frameworks and beam frameworks are provided in which said column reinforcement bars and beam reinforcement bars are arranged precisely at predetermined positions and a thickness of concrete coated over each reinforcement bar is maintained precisely at a predetermined thickness.

According to the present invention, since concrete is placed within the sheathing boards of the column frameworks and beam framewords after the preliminarily constructed respective frameworks have been assembled at the site of a building as described above, a framed construction of reinforced concrete having a high precision can be built. In addition, in the above-described respective frameworks, owing to the aforementioned column reinforcement frames and beam reinforcement frames disposed at predetermined intervals along the column reinforcement bars and beam reinforcement bars, respectively, shearing reinforcement for the columns or beams is effected, and hence a reinforced concrete structure having an excellent earthquake resistance can be built.

Moreover, according to the present invention, since the perpendicular upright edges extending from the outer peripheries of the rectangular frame pieces of the column reinforcement frames and beam reinforcement frames are utilized to connect the column sheathing boards and beam sheathing boards surrounding the column reinforcement bars and beam reinforcement bars to the respective frameworks by means of connecting members, said respective reinforcement frames serve both as shearing reinforcement members and fixing members for fixing the sheathing boards the need for members and materials for temporary work such as end thick members, sheathing board fastening members, etc. is greatly reduced, working is simplified, and due to the combination of the column reinforcement bars and beam reinforcement bars with the sheathing boards, finishing work becomes unnecessary.

Furthermore, according to the present invention, since preliminarily constructed column frameworks and beam frameworks associated with sheathing boards are used and these frameworks are assembled to the site of the building, the work is greatly simplified, construction cost is reduced, and by standardizing the column and beam members, manufacture of the frameworks in a plant is made possible.

According to another feature of the present invention, there is provided the above described method for building a reinforced concrete structure including the additional steps of disposing column shearing reinforcement bands and beam shearing reinforcement bands between adjacent column reinforcement frames and beam reinforcement frames, respectively, so as to surround said column reinforcement bars and said beam reinforcement bars, respectively, each of said bands consisting of a metal strip bent into a rectangular frame shape, and connecting said respective bands to said column sheathing boards and said beam sheathing boards, respectively, by means of connecting members.

By the use of the above-described additional feature of the present invention, a reinforced concrete structure having an excellent construction and reinforced against shearing in the columns and beams can be built.

The above-described and other features and advantages of the present invention will become more apparent by reference to the following description taken in conjunction with the accompanying drawings, wherein.

Figure 1:
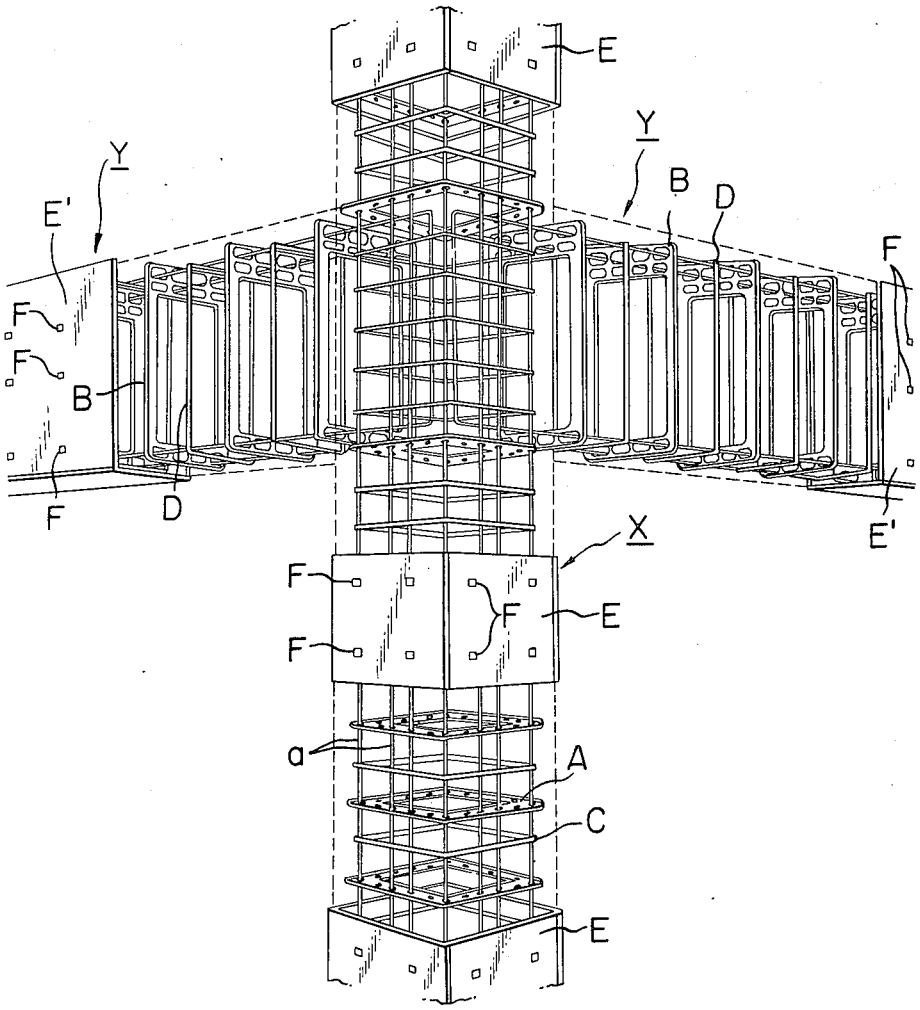
FIG. 1 is a partial perspective view showing a reinforcing framework for a concrete building structure assembled by the method according to the present invention.
Figure 2:
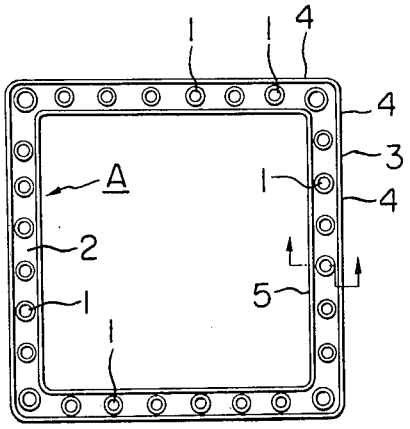
FIGS. 2 and 3 are plan and side views, respectively, of a column reinforcement frame to be used according to the present invention.
Figure 3:
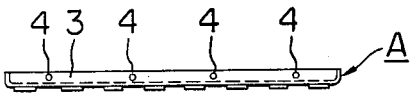
Figure 4:
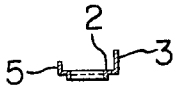
FIG. 4 is a sectional view taken on line 4—4 of FIG. 2.
Figure 5:
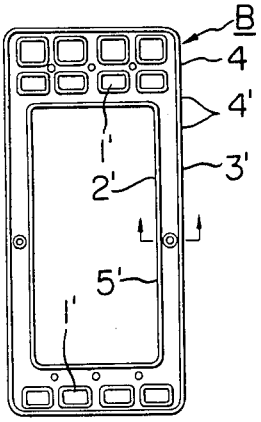
FIGS. 5 and 6 are plan and side views, respectively, of a beam reinforcement frame to be used according to the present invention.
Figure 6:
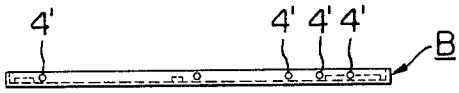
Figure 7:
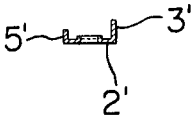
FIG. 7 is a sectional view taken on line 7—7 of FIG. 5.
Figure 8:
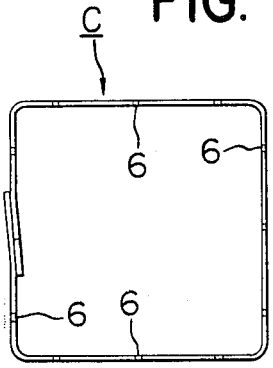
FIGS. 8 and 9 are plan views of a column shearing reinforcement band and a beam shearing reinfocement band, respectively, to be used according to one preferred embodiment of the present invention.
Figure 9:
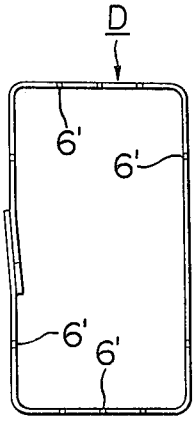

Referring now to the drawings, reference character (A) designates a column reinforcement frame shaped from a steel plate by pressing, and this frame has a perpendicular upright edge (3) extending from the outer periphery of a rectangular frame piece (2) in which reinforcement bar insertion holes (1) are arrayed and in the perpendicular upright edge (3) are arrayed mounting bores (4). Reference numeral (5) designates another perpendicular upright edge extending from the inner periphery of the aforementioned rectangular frame piece (2).

Reference character (B) designates a beam reinforcement frame shaped from a steel plate by pressing, and similarly to the column reinforcement frame (A) this frame is constructed in such manner that perpendicular upright edges (3') and (5') extend from outer and inner peripheries of a rectangular frame piece (2') in which reinforcement bar insertion holes (1') are arrayed and in the perpendicular upright edge (3') are arrayed mounting bores (4').

Reference character (C) designates a column shearing reinforcement band which is formed by bending a steel strip into a rectangular frame shape, and which has nail holes (6) arrayed along its peripheral edge.

Reference character (D) designates a beam shearing reinforcement band which is formed by bending a steel strip into a rectangular frame shape, and which has nail holes (6') arrayed along its peripheral edge.

Figure 10:
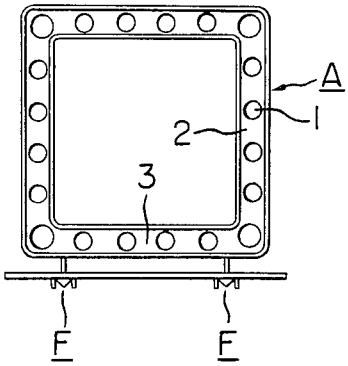
FIGS. 10 through 14 are front views showing the successive steps in the process for assembling a column framework.
Figure 11:
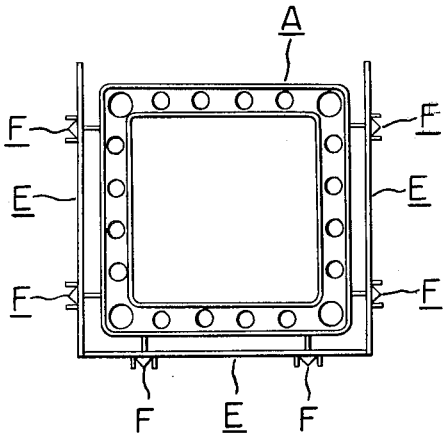

As shown in FIGS. 10–14 a lower sheath board (E) is placed on a floor, then column reinforcement frames (A) are disposed at predetermined intervals therealong, and the perpendicular upright edges of the column reinforcement frames (A) are connected to the sheathing board (E) by connecting members (See FIG. 10).

Figure 19:
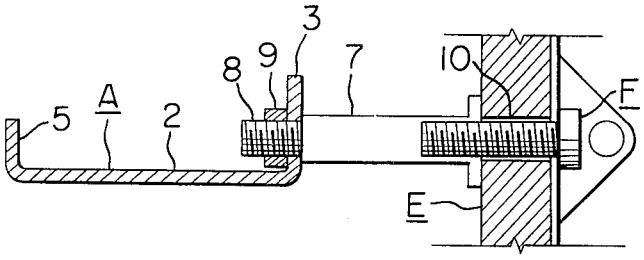
FIGS. 19 to 21 are longitudinal cross-section views showing different types of connecting members for connecting a column or beam reinforcement frame and a sheathing board.
Figure 20:
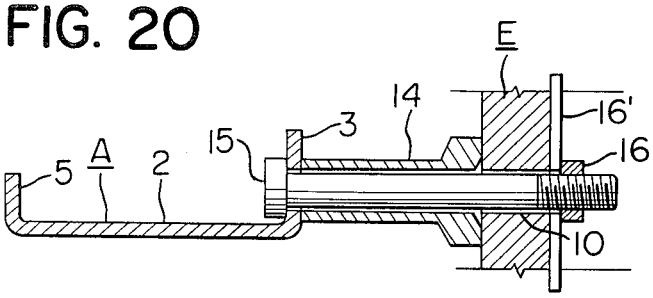
Figure 21:
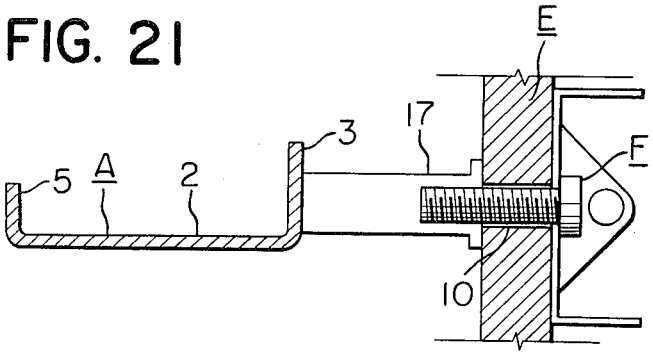
Figure 22:
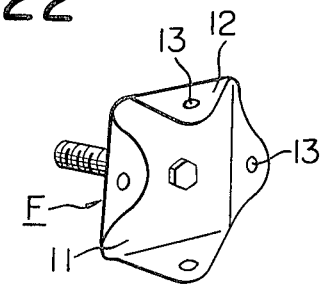
FIG. 22 is a perspective view of a bolt with handles.

FIGS. 19 to 21 show the details of the connecting members. In the first type of connecting members shown in FIG. 19, a threaded rod portion (8) projecting from a stepped portion at a tip end of a connecting member (7) having a threaded bore at its rear end is fitted into a bore (4) in the perpendicular upright edge (3) of the aforementioned reinforcement frame (A), and is fastened by a nut (9), and then a bolt (F) having associated handles is inserted into a bore (10) drilled in the sheathing board (E) and screwed into the threaded bore at the rear end of the aforementioned connecting member (7) to thereby connect the column reinforcement frame (A) to the sheathing board (E). It is to be noted that a handle portion (11) of the above-mentioned bolt (F) is formed in such manner that ears (12) project from the periphery of a square metal plate to which a bolt body is studded, and by making use of bores (13) drilled in these ears (12) stay wires can be fastened thereto for erecting a column skeleton (See FIG. 22).

In the second type of connecting member shown in FIG. 20, a tubular spacer (14) made of synthetic resin or the like is interposed between the perpendicular upright edge (3) of the column reinforcement frame (A) and the sheathing board (E), a bolt (15) inserted through the bore (A) in the aforementioned upright edge (3) is extended through the spacer (14) and a bore (10) of the sheathing board (E), and a nut is threaded onto the end of the bolt to connect the sheathing board (E) to the column reinforcement frame (A). In FIG. 20, reference numeral (16') designates a washer.

In the third type of connecting member shown in FIG. 21, mounted on the lower sheathing board (E) at predetermined extends through the bore (10) of the sheathing board (E) is screwed into a threaded bore in a connecting rod (17) welded to the perpendicular upright edge (3) of the sheathing board (E), and is fastened to connect the column reinforcement frame (A) to the sheathing board (E).

Figure 12:
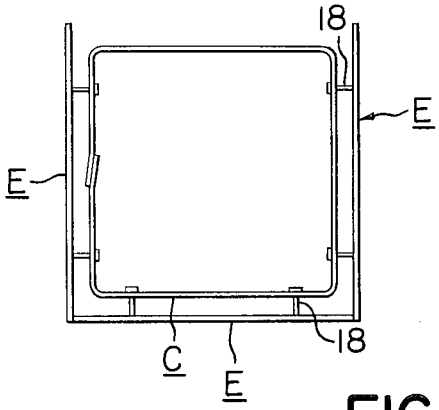
Figure 13:
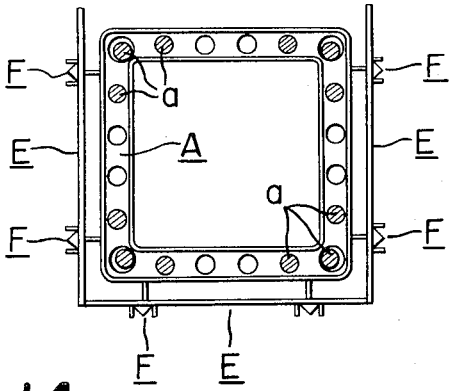
Figure 14:
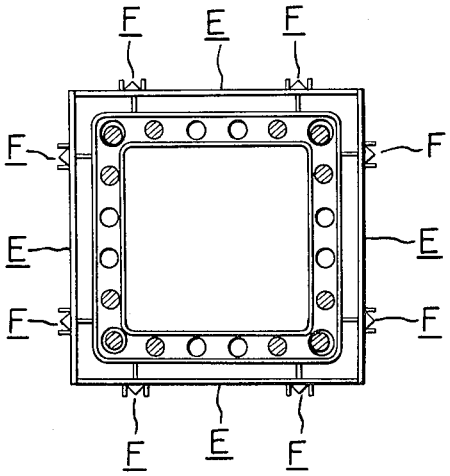
Figure 15:
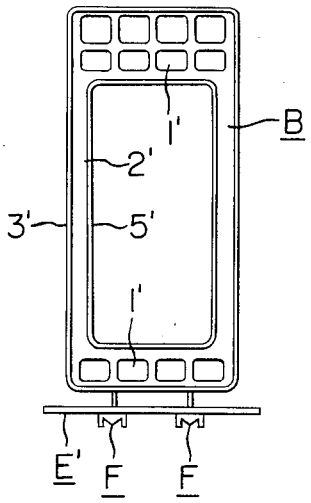
FIGS. 15 through 18 are front views showing the successive steps in the process for assembling a beam framework.
Figure 16:
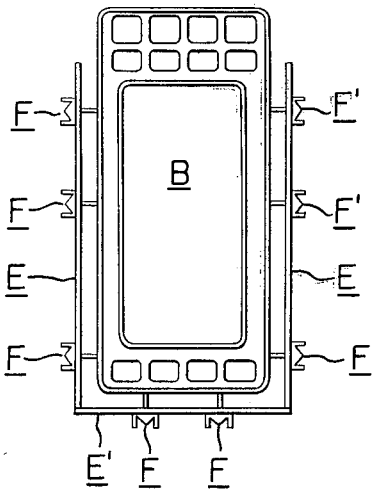

Thus, after the column reinforcement frames (A) have been mounted to the lower side sheathing board (E) at a predetermined intervals in the above-described manner, sheathing boards (E) are disposed on the opposite sides of the lower side sheathing board (E) and are mounted on the opposite sides of the column reinforcement frame (A) in the same manner as described above as shown in FIG. 11, and subsequently the necessary number of column shearing reinforcement bands (C) are disposed between adjacent column reinforcement frames (A) as shown in FIG. 12, and these bands are fixedly secured to the respective sheathing boards (E) with nails (18) by making use of the nail holes or mounting holes (6). Next, as shown in FIG. 13, column reinforcement bars (a) are inserted into the respective reinforcement bar insertion holes (1) at the four corners of the respective column reinforcement frames (A), furthermore, column reinforcement bars (a) other than those positioned at the four corners are inserted into the corresponding reinforcement bar insertion holes (1) in the respective column reinforcement frames (A) and are temporarily secured to the reinforcement frames by means of binding wires, also the aforementioned column shearing reinforcement bands (C) are temporarily secured to the column reinforcement bars by means of binding wires, and after bending and other deformations as well as deviation of the groups of reinforcement bars have been corrected, an upper sheathing board (E), is mounted on the respective column reinforcement frame (A) as shown in FIG. 14, and thereupon construction of a column mold (X) is completed.

Figure 17:
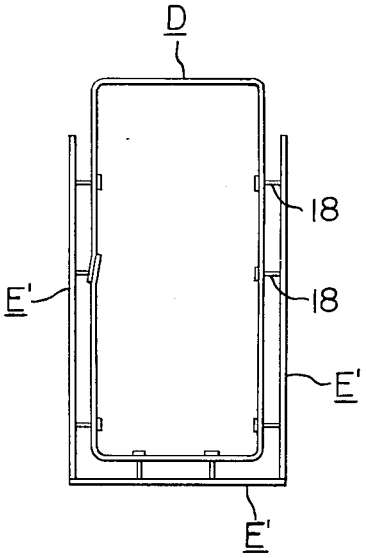
Figure 18:
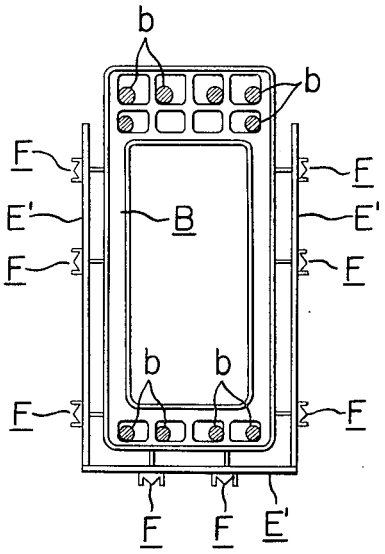

On the other hand, for the construction of a beam mold, as shown in FIGS. 15–18, beam reinforcement frames (B) are mounted at predetermined interval to a lower side beam sheathing board (E') positioned at the bottom of the beam and subsequently a pair of beam sheathing boards (E') is disposed on the opposite sides of the lower side beam sheathing board (E') and the boards are mounted on the respective beam reinforcement frames (B) (See FIG. 16), and a desired number of beam shearing reinforcement bands (D) are disposed between adjacent beam reinforcement frames (B) and are temporarily secured to the sheathing boards (E') by means of nails (18) similarly to the above-described column shearing reinforcement bands (C) (See FIG. 17). Next, beam reinforcement bars (b) are inserted into reinforcement bar insertion holes (1') of the respective beam reinforcement frames (B) as shown in FIG. 18, the beam reinforcement bars (b) are temporarily secured to the beam reinforcement frames (B) and the beam shearing reinforcement bands (D) similarly to the above-described column reinforcement bars (a), and after bending and other deformations as well as deviation of the reinforcement bar group have been corrected, anchoring of the end portions of the beam is effected, and thereupon construction of the beam mold (Y) is completed.

Figure 23:
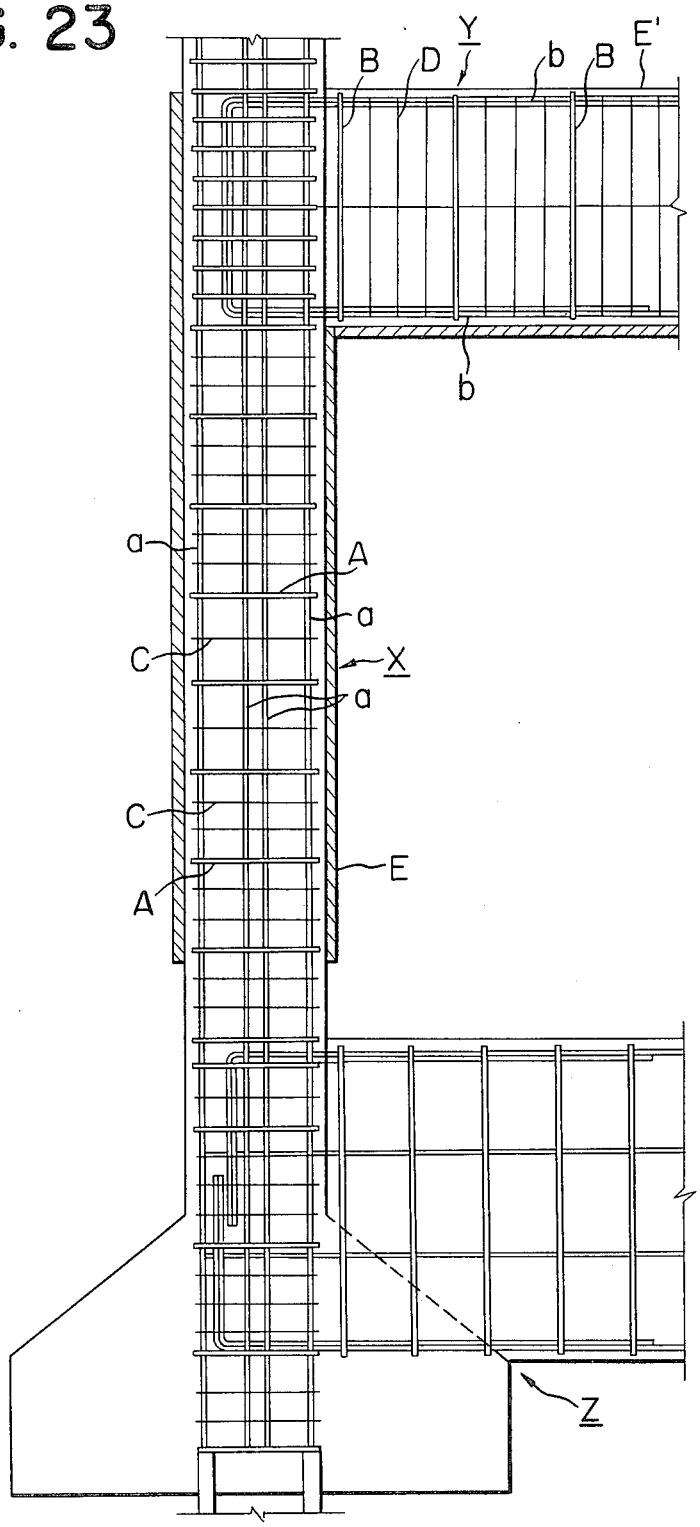
FIG. 23 is a front view showing an assembly of column frameworks and beam frameworks.

The column molds (X) and beam molds (Y) which have been primarily constructed in the above-described manner, are conveyed to the site of a building, the column molds (X) are erected at predetermined positions, column reinforcement bars (a) projecting from the lower end of the sheathing boards (E) are anchored to the foundation (Z), and the beam molds (Y) are laterally mounted between adjacent column molds (X). Thereupon, the end portions of the beam reinforcement bars (b) projecting from the ends of the sheathing boards (E') in the beam mold (Y) are inserted and fitted into the column molds (X) through notched portions of the sheathing boards provided on the faces of the column molds (X) (See FIGS. 1 and 23).

Subsequently, concrete is placed within the sheathing boards (E') of the above-described column molds (X) and beam molds (Y).

It is to be noted that when the column molds (X) are connected vertically, the lower ends of the reinforcement bars (a) in the column mold (X) disposed in the upper position are joined to the upper ends of the column reinforcement bars (a) in the column mold (X) disposed in the lower potition as by a gas pressure welding process.

Thus after the placed concrete has hardened, the sheathing boards (E) are removed, and thereupon the building frame of a reinforced concrete structure is completed.

Since many changes could be made in the above construction and many apparently widely different embodiments of the invention could be made without departing from the scope thereof, it is intended that all matter contained in the above description or shown in the accompanying drawings shall be interpreted as illustrative and not as a limitation on the scope of the invention.

What is claimed is:

1. A method for building a reinforced concrete structure, comprising the steps of: providing reinforcement frames having a rectangular frame piece with reinforcement bar holes arrayed therein and a perpendicular upright edge around the outer periphery thereof; positioning sets of pluralities of said frame pieces with the frame pieces in each set at predetermined intervals; inserting reinforcement bars into the reinforcement bar holes in the frame in each set to form column reinforcement frames and beam reinforcement frames; connecting sheathing boards to said perpendicular upright edges of the frame pieces in each of said frames by rigid connecting members to from column molds and beam molds with the sheathing boards positively spaced from said frame pieces and the reinforcement bars therein a distance corresponding to the length of said connecting members; assembling the column molds and beam molds into a structure corresponding to the frame of the structure to be constructed at the building site; and placing concrete withing the sheathing boards in the respective molds.

2. A method as claimed in claim 1 further comprising, after the step of inserting the reinforcement bars, the step of placing shearing reinforcement bands around said reinforcement bars at positions intermediate said frame pieces, and, as said sheathing boards are being placed in position, connecting said sheathing boards and said reinforcement bands.

3. A method for building a reinforced concrete structure, comprising the steps of: providing reinforcement frames having a rectangular frame piece with reinforcement bar holes arrayed therein and a perpendicular upright edge around the outer periphery thereof; placing a first sheathing board for a mold on a supporting surface; positioning a plurality of said frame pieces at predetermined intervals along said sheathing board with the upright edge along one side facing the sheathing board, and then connecting said frames to said sheathing board by connecting rigid connecting members laterally between said sheathing board and the portion of said upright edge facing the sheathing board; placing further sheathing boards parallel to the side edges of said frame piece which are next adjacent the ends of the side edge facing said first sheathing board and connecting rigid connecting members laterally between the upright edge along the side edges of said frame pieces and said further sheathing boards; inserting reinforcement bars into the reinforcement bar holes in the frame pieces to form a reinforcement frame; placing a final sheathing board parallel to the remaining side edge of said frame pieces and connecting rigid connecting members laterally between said final sheathing board and the upright edge along said remaining side edge of said framepieces to form a mold; making a plurality of other molds, some of said molds being for columns and others being for beams; assembling column molds and beam molds into a structure corresponding to the frame of the structure to be constructed at the building site; and placing concrete within the sheathing boards in the respective molds.

* * * * *